United States Patent [19]

Denzine et al.

[11] 4,078,951

[45] Mar. 14, 1978

[54] METHOD OF IMPROVING FATIGUE LIFE OF CAST NICKEL BASED SUPERALLOYS AND COMPOSITION

[75] Inventors: Allen F. Denzine, Chardon; Thomas A. Kolakowski, Cleveland; John F. Wallace, Shaker Heights, all of Ohio

[73] Assignee: University Patents, Inc., Stamford, Conn.

[21] Appl. No.: 672,350

[22] Filed: Mar. 31, 1976

[51] Int. Cl.[2] ..... C22C 19/05

[52] U.S. Cl. ..... 148/32.5; 75/82; 75/171

[58] Field of Search ..... 75/171, 170, 82; 148/32, 32.5

[56] References Cited

U.S. PATENT DOCUMENTS

| | | | |
|---|---|---|---|
| 3,459,545 | 8/1969 | Bieber et al. | 75/171 |
| 3,620,719 | 11/1971 | Wheaton et al. | 75/171 |

*Primary Examiner*—R. Dean
*Attorney, Agent, or Firm*—Fay & Sharpe

[57] ABSTRACT

The invention consists of a method of producing a fine equiaxed grain structure (ASTM 2-4) in cast nickel-base superalloys which increases low cycle fatigue lives without detrimental effects on stress rupture properties to temperatures as high as 1800° F. These superalloys are variations of the basic nickel-chromium matrix, hardened by gamma prime [$Ni_3$ (Al, Ti)] but with optional additions of cobalt, tungsten, molybdenum, vanadium, columbium, tantalum, boron, zirconium, carbon and hafnium. The invention grain refines these alloys to ASTM 2 to 4 increasing low cycle fatigue life by a factor of 2 to 5 (i.e. life of 700 hours would be increased to 1400 to 3500 hours for a given stress) as a result of the addition of 0.01% to 0.2% of a member of the group consisting of boron, zirconium and mixtures thereof to aid heterogeneous nucleation. The alloy is vacuum melted and heated to 250°-400° F. above the melting temperature, cooled to partial solidification, thus resulting in said heterogeneous nucleation and fine grains, then reheated and cast at about 50°-100° F. of superheat. Additions of 0.1% boron and 0.1% zirconium (optional) are the preferred nucleating agents.

16 Claims, No Drawings

METHOD OF IMPROVING FATIGUE LIFE OF CAST NICKEL BASED SUPERALLOYS AND COMPOSITION

The invention herein described was made in the course of or under a contract or subcontract thereunder, with the Department of the Air Force.

SUMMARY OF THE INVENTION

The subject invention generally relates to superalloys of cast nickel-base type, such as in U.S. Pat. No. 2,570,193; however, the method of casting the superalloys has been changed to produce improved fatigue life without sacrificing the creep rupture strength. This is accomplishd by grain refining to ASTM 2–4, thus increasing the fatigue life by a factor of 2–5 (typically 4, i.e. at a given stress a life of 700 hours, non-refined is 2800 hours refined) with the addition of 0.01% to 0.2% of a member of the group consisting of boron, zirconium and mixtures thereof to aid heterogeneous nucleation. A special melting condition is used consisting of 250°–400° F. of superheat in a vacuum, followed by cooling to partial solidification and then pouring at about 50°–100° F. superheat. This technique permits the formation of particular compounds which possess the characteristics of substrates for heterogeneous nucleation.

INTRODUCTION

Once used solely in high performance military aircraft, gas turbines are now used in a variety of aircraft, marine, industrial, and vehicular applications. Since the early 1960's a trend of rapidly rising turbine inlet temperatures has been evident because of the increase in efficiency of a gas turbine engine with increasing turbine inlet temperature. The growing demands of advancing gas turbine engine technology have paced the development of high strength heat-resistant superalloys. To keep pace with the increasing temperature in recent years, a growing sophistication has occurred in the approaches taken toward the development of more capable alloys. These approaches have included directionally solidified alloys and eutectics, superalloy powder metallurgy, dispersion strengthening, and processing improvements. However, the disparity which exists between alloy capability and the rise in inlet temperature has not been offset completely by advancements in component cooling concepts. Therefore, a very real need for improved materials remains.

SERVICE CONSIDERATIONS

While the high temperature capability of an alloy is most commonly expressed in terms of a temperature to product rupture in 100 hours at a given stress, several additional properties must be considered. The choice of which properties are most critical depends on the location in the gas turbine under consideration. The subject invention is most concerned with the hot section of the gas turbine engine, with emphasis on improving the properties of the turbine rotor.

A rotor is customarily divided into three general areas: the hub, the rim, and the blades. The hub section is located near the axis of the disc where the operating temperatures are low (approximately 500° F) but stresses from centrifugal loads are high. High tensile strength and good fatigue resistance (both high-cycle and low-cycle) are primary requirements in the hub section. The rim section is the outer region of the disc in the area of blade attachment. In this region temperatures of 1400° F. (760° C.) add hot corrosion resistance and creep strength to the fatigue and tensile requirements. In the blade section, where operating temperatures are the highest, up to 1800° F. (980° C.), creep resistance is of primary importance. Creep resistance, for long service life, demands that the alloy be capable of accommodating plastic deformation with high strength to prevent catastrophic, unpredictable component failure. The blade root is subjected to temperatures of 1400°–1600° F. and stresses of 40,000 to 80,000 psi, and requires strength, ductility (to accommodate creep deformation), and low-cycle fatigue resistance. Steep thermal gradients of 500° F. along a blade span in normal engine operation add to the combination of fatigue and creep. Since these parts are in contact with high-temperature combustion products of high oxygen content, good oxidation resistance is mandatory. Resistance to surface degradation by hot corrosion (oxidation in combination with sodium, sulfur, vanadium, and other fuel or air contaminants) is also an important requirement.

All three sections of the rotor are subjected to mechanically and thermally induced cyclic strain. The mechanical strains have a high mean strain (from the centrifugal loading) with a low alternating strain from vibrations of the spinning rotor. The frequency of the cyclic strain in the hub and rim depends upon rotational speed, while the blade and blade root experience higher frequencies from air-foil twist and bending.

The thermally induced cyclic strain arises during acceleration and deceleration of the turbine. During acceleration, turbine blade leading and trailing edges heat up faster and expand more than the cooler mid-chord region. This nonuniform heating results in internal stresses which are compressive in the hotter regions and tensile in the cooler regions. Following acceleration is an equilibrium period during which a nearly uniform temperature is present across the blade. On deceleration, the leading and trailing edges cool more rapidly than the center region resulting in tensile stresses in the cooler edges and compression in the hotter center.

ROTOR DEVELOPMENT: ALLOYS AND PROCESSES

Turbine rotors are frequently produced as an integral wheel (blades and disc are a single piece) using a vacuum investment casting process. Several nickel-base superalloys are used to produce the rotors including 713 C, 713 LC, MAR-M 246, IN 792, etc. An overview of superalloys is provided in "Strengthening Mechanisms in Nickel-Base Superalloys" by R. F. Decker, as presented at the Steel Strengthening Mechanisms Symposium, May 5 and 6, 1969, Zurich, Switzerland. The detailed compositions of all superalloys are provided therein and are incorporated by reference into this application. Specifically, the alloys are in the following references:

713 C; U.S. Pat. No. 2,570,193
713 LC; U.S. Pat. No. 3,166,412 (see table)
MAR-M 246; U.S. Pat. No. 3,164,465
IN 792; U.S. Pat. No. 3,619,182

C-103, which is a hafnium nickel-base superalloy, is described in U.S. Pat. Nos. 3,005,705, 3,677,746, 3,677,747 and 3,677,748. Representative examples of the developments are explained in the following U.S. patents:

U.S. Pat. Nos. 3,260,505 (MAR-M 200)
3,494,709
3,164,465
3,677,748
3,005,704
3,619,182
2,809,110
3,276,866
3,645,726
3,005,705
3,677,746
3,310,399
3,061,426
2,798,827
3,107,167
2,570,193
3,763,926
3,061,426
3,166,412
3,677,747
2,948,606
3,026,198
3,385,698
3,567,526
3,869,284
3,915,761

The following table gives examples of cast nickel-base superalloys to which the present invention applies:

| Cast Superalloys * | Weight percent |
|---|---|
| Carbon | 0.02 - 0.17 |
| Chromium | 6.0 - 20.0 |
| Cobalt | 2.0 - 15.0 |
| Molybdenum | 1.7 - 6.0 |
| Tungsten (W) | 2.5 - 20.0 |
| Columbium | |
| Tantalum | 0.9 - 6.5 |
| Iron | 0 - 4.5 |
| Titanium | 0.1 - 4.7 |
| Aluminum | 2.0 - 8.0 |
| Boron | 0.001 - 0.20 |
| Zirconium | 0.00 - 0.50 |
| Nickel | Balance |
| plus impurities as low as possible. | |

* Adapted from "Strengthening Mechanisms in Nickel-Base Superalloys", R. F. Decker; Steel Strengthening Mechanisms Symposium, Zurich, Switzerland, May 5-6, 1969.

The composition of MAR-M 246 (a Martin Marietta Corporation designation) is a cast nickel alloy and taught in U.S. Pat. No. 3,164,465:

"Basically, the metal alloy of this invention is comprised by weight of: from about 6% to about 17% of chromium; from about 5% to about 20% of tungsten; from about 0.25% to about 3% of columbium or tantalum or mixtures thereof; from about 2% to about 8% of aluminum; from about 0.1% to about 3% of titanium with the provision that the amount of titanium does not exceed the amount of aluminum; from about 2% to about 15% of cobalt; at least one of the metals in the amounts indicated selected from the group consisting of from about 0.001% to about 0.5% of zirconium and from about 0.001% to about 0.2% of boron; from about 0.02% to about 0.35% of carbon; and the remainder being nickel and incidental impurities, the nickel content being in the range of about 45% to about 77%."

More specifically, the alloy is of the composition shown in the above table, by way of example, and further is taught in Table II of U.S. Pat. No. 3,869,284 (D).

Before proceeding with the details of rotor production, a brief review of the evolution of superalloys and related processes is in order.

In the early 1940's the first precipitation hardening nickel-base (80% nickel, 20% chromium) alloys were developed. Precipitation hardening was achieved by the alloying addition of aluminum and titanium which formed the gamma prime precipitate in the FCC (gamma) matrix. The gamma prime phase is the FCC coherent intermetallic phase $Ni_3(Al, Ti)$. During the late 1940's molybdenum was added as a solid-solution and carbide forming strengthener, and the alloys were used extensively in the production of forged turbine blades. Processing, at this point, was limited to air-melted wrought nickel-base alloys.

By the late 1950's, increasing turbine operating temperature was limited by the capabilities of wrought alloys. The introduction of vacuum induction melting greatly improved the quality and properties of the existing alloys. Vacuum melting removes oxygen and nitrogen from the melt, preventing their reaction with aluminum and titanium to form oxide and nitride inclusions. Titanium and aluminum are thus retained for subsequent gamma prime formation. Alloys of greater strength were available by varying the composition, but no methods were available to forge alloys with such exceptional strength at high temperatures. The needed strength was made available by induction melting and investment casting wholly under vacuum. The vacuum investment casting made it possible to closely control alloy composition, maintain dissolved gases at low levels, and facilitate mold filling. This resulted in the use of lower metal pour temperatures, allowing greater control of grain size.

With these improvements, a new family of nickel-base superalloys evolved, specifically designed for high temperature capability and for production as vacuum investment cast parts. The microstructures of these alloys consists of an FCC solid-solution matrix, carbides, and the coherent intermetallic phase, gamma prime. These alloys are strengthed principally by aluminum, titanium, columbium, and tantalum, which combine with nickel to form the FCC gamma prime. Additions of cobalt raise the gamma prime solvus temperatures, thus improving strength at high temperatures. Carbides are the principal second phases. Various carbides exist, depending on alloy composition and heat treatment. Carbon (added at levels of about 0.05 to 0.2%) reacts with refractory elements present to form primary MC carbides (large blocky-spherical particles) which decompose to form lower carbides such as $M_{23}C_6$ and $M_6C$, which are located at the grain boundaries. Strength is also increased by elements in solid-solution, the most effective of which are molybdenum, tungsten, and chromium. Aluminum and chromium provide oxidation resistance, and chromium and titanium are effective in imparting hot-corrosion resistance. Small additions of boron and zirconium greatly improve stress-rupture properties. Boron, in the form of an $M_3B_2$ boride, is present at the grain boundaries. The most recent alloys include the addition of 1-2% hafnium which alters carbide, grain boundary, and gamma prime morphologies to improve the transverse ductility of columnar grained castings. With increasing operating temperatures and higher stresses, additional strength at higher temperatures was required. This was accomplished by variations in processing. Dispersion hardening was obtained by powder metallurgy procedures with the use of thoria dispersed nickel and nickel-chromium alloys. The $Y_2O_3$ dispersed alloys were developed later. These had the combined advantage of the strength of TD nickel above 1500° F. (815° C.) and gamma prime strengthening at lower temperatures. Variations in the thermo-mechanical processing cycles of conventional superalloy forgings show promise of improving performance at temperatures below 1400° F. (760° C.).

In 1966, advances were made in the control of the direction of solidification, enabling the production of investment castings containing columnar grains oriented parallel to the major stress axis. This grain orientation greatly improves resistance to intergranular fracture at elevated temperatures, thus improving creep strength, ductility, and thermal fatigue resistance. As a further improvement, grain boundaries have been eliminated as the sites of crack initiation and chemical segregation by casting single crystals using the longitudinal solidification techniques with control of grain seeding. This procedure has shown advantages in terms of stress-rupture properties and corrosion resistance.

A class of composite materials that offers the possibility of improvement in high temperature performance are the in-situ composites, specifically the directionally solidified eutectics. These materials generally have an aligned two-phase structure consisting of a hard, brittle reinforcement phase in a matrix of a more ductile material. The aligned structure is formed during unidirectional solidification from a homogeneous liquid phase.

The main emphasis of alloy and process development has been to improve the stress-rupture properties and thermal fatigue resistance in blade sections. For the turbine rotor under consideration in this present invention, failure is not occurring from a stress rupture or thermal fatigue condition in the blades but from combined thermal and mechanical fatigue in the rim and hub. This condition occurs because this rotor is used in a relatively low temperature application. Stress-rupture properties in the blades are sufficient to reveal the fatigue properties in the rim and hub as the "weakest link".

Nickel base superalloys are limited by their rather poor fatigue properties. When comparing the ratio between endurance limit and yield strength (normalized endurance limit at $10^6$14 $^7$cycles) of nickel-base superalloys to those of other metals and alloys, the nickel alloys are inferior, with normalized endurance limit of about 0.25 compared with 0.5 to 1.0 for aluminum and iron alloys. The nickel-base alloys are used in fatigue applications only because the endurance limit is maintained at elevated temperatures. The poor fatigue behavior is a consequence of the planar slip mode which is operative to approximately 1400° F. (760° C.). Fatigue life is then governed by the fast crack propagation rates along planar slip bands and through carbide phases. Therefore, to attain the ultimate in fatigue properties, structural heterogeneities should be eliminated and slip dispersed.

The approach toward improving stress-rupture properties has been to control the solidification behavior to minimize the grain boundary material oriented normal to the major stress direction; the extreme example of this is single crystals. Solidification control can similarly be used to improve fatigue properties by the production of a uniform, fine equiaxed grain size. Improved low-cycle fatigue resistance with a reduction in grain size has been obtained in work involving wrought nickel-base superalloys. A similar increase in tensile properties occurs with inoculated and refined cast alloys.

A homogeneous fine equiaxed structure has considerable advantage of providing uniform properties in all directions compared to the anisotropic response of a columnar grained material. Finally, the fine grains tend to disperse slip and to minimize segregation and structural heterogeneities by reducing their density and size.

It should be initially pointed out that two separate mechanisms are going on when these alloys break down. One is called creep (stress rupture) and the other is called fatigue. The approaches used to correct either of these two problems are quite different. The prior art has been directed toward the creep mechanism, whereas the subject invention is directed toward the fatigue mechanism. Some of the same kind of methods are used, but with a different emphasis and a different processing technique.

The development of the gas turbine has been limited by the materials used in the hot section. There exists a strong driving force to increase operating temperature since both power output and efficiency increase as temperature increases.

In general, the thing that has limited the material development has been the failure mode of the material. During the fifties the primary failure mode of material was creep, or stress rupture (stress rupture is very rapid creep). The creep or stress rupture mechanism is stirctly a high temperature mechanism (in excess of one half the melting point of the material) with the applied stress constant in time. Stress rupture occurs in the three distinct stages. This is exactly what one would expect to fine in a turbine rotor. When spinning occurs and there is constant centrifugal loading, the parts elongate until failure. Until this hurdle was overcome, the development couldn't progress. Metallurgists approached this problem in two ways. One was to vary the composition of the alloy; the second was to modify or control the structure of the material itself. In terms of alloy composition variation, the obvious thing was to increase the refractory content. This was accomplished by adding high melting point material. (When the melting point is increased, the temperature capability is increased.) These were materials with high temperature strength, such as Co, W, Mo, Cb, Ta. The second thing to do would be to remove carbon. Carbon forms primarily carbide in the grain boundary. Third, Hf was added to modify the grain boundary structure and eliminate sliding. Fourth, the addition of boron and zirconium was accomplished, again to modify the grain boundary structure by the addition of odd-size atoms for the elimination of sliding. Fifth would be to increase the total gamma prime volume fraction by increasing the titanium and aluminum content.

The second means to modify or improve the stress rupture properties of an alloy would be through the modification or control of the alloy structure. (Structural modifications are the direct result of chemical modifications.) The alloy may be modified in two ways: 1) the grains, and 2) the grain boundaries. To modify the grains the volume fraction of gamma prime is increased. Secondly, grains may be modified by altering the size and distribution of gamma prime particles. Modification of the grain boundaries, on the other hand, may be accomplished in two ways. One is by the removal of the embrittling phases (carbides) or by coating them with gamma prime. The second means would be the elimination of sliding by the addition of boron, zirconium, or hafnium. The primary creep mechanism of failure is called grain boundary sliding. Odd-sized atoms of either boron zirconium or boron and hafnium are used to pack into the grain boundary so that sliding is inhibited. Hafnium forms a gamma prime eutectic. It is circularly shaped and looks like a series of knuckles so that the two planes cannot slide. It should also be pointed out that the prior art points to the usage of boron and zirconium strictly in the grain boundaries to prevent grain boundary sliding. [See U.S. Pat. Nos. 3,869,284, 3,726,722 and 3,362,816.] This appears to be the only function the prior art has established for the use of boron and zirconium as additives. Modification or control of sturcture, in addition to control of grain or grain boundaries, can be accomplished external to the grains. This can be done by modifying the way in which the grain is formed and accomplished by three methods: 1) directional solidification, 2) directional solidification eutectics, and 3) directionally solidified single crystals. Examples are noted in U.S. Pat. Nos. 3,915,761, 3,260,505, 3,474,709, 3,677,835, and 3,700,433.

As can be seen, emphasis has been on improving high temperature strength by alloy modification and to reduce grain boundary sliding by compositional structure. In particular, unidirectional solidification has been used in controlled structure since boundaries are a source of trouble in creep applications. The structures are solidified so that the grain boundaries are oriented parallel to the direction of the applied stress, thereby minimizing their effect.

Metallurgists have done such a good job in improving creep strength that the weakest link in the performance of these alloys is now fatigue; the failure mode is no longer creep, but fatigue.

Fatigue failures are generated by cyclic loading. Particularly damaging is the combination of thermal and mechanical stress cycles (present in the turbine rotor which produce high strains and shortened fatigue life.

To improve the fatigue properties, two approaches are available: 1) varying alloy composition, and 2) controlling structure. In terms of varying the composition, the first thing is to increase the refractory content and thereby improve the hot strength. This has already been accomplished. Secondly, titanium and aluminum are added to increase the gamma prime volume fraction, or boron and zirconium may be added, but, again, this has been done. In addition, the composition need not be varied for it has already been optimized for creep. An alternative is to try to control the gamma prime and carbides. To control the structure there are two things that come to mind. One is to vary gamma prime and carbides, by size and distribution, morphology. Those are already controlled by the alloy composition variations, and it is not desirable to modify the composition. Therefore, what is left is to modify the grains. One manner of improving fatigue is by grain refinement rather than using a large grain formed by directional solidification. The reason for the use of fine grains is that they disperse slip. Creep occurs by sliding along grain boundaries, whereas fatigue occurs by sliding along crystographic planes instead of sliding in the direction that creep does. In theory, grain refinement is beneficial to fatigue performance due to two factors: 1) it increases dispersion of slip with fine grains thereby making slip more difficult and eliminating "planes of weakness"; and 2) it reduces anisotropy (directionality) in the finished components due to the presence of randomly oriented fine grains.

However, grain refinement of nickel-base superalloys is a difficult task due to complexity of the alloy system, limitations imposed by mold dimensions and cooling rates, and the incomplete development of the theory regarding the nature of grain refinement phenomena.

The technique employed in the subject invention is based on "nucleation and growth theory", in which the presence of two factors is required: 1) suitable substrates for heterogeneous nucleation; and 2) constitutional super-cooling. The high solute content of these alloys provides efficient constitutional supercooling, which, in conjunction with a shallow thermal gradient and rapid solidification rates present in the investment mold, produces the desired equiaxed grains. The size of these grains is determined by the number of nuclei present in the melt from which independent grains can grow. The grain refinement technique herein provided is to a method for producing sufficient substrates for the formation of nuclei which then grow into individual grains.

Thus, from the above it has been shown that fatigue failures have emerged at the "weakest link" in turbine rotors. The presence of fine equiaxed grains improves fatigue life (by a factor of four). The grain refinement technique of the subject invention (structural control) uses boron (or boron and zirconium) additions to form particular substrates at a particular temperature. These additions serve a secondary purpose separate from and in addition to the boron and zirconium already present in the master alloy. The process is unique through development of the grain refinement technique by thermal processing. In this manner mechanical fatigue, tensile and oxidation properties are improved without sacrifice in thermal fatigue or stress rupture life and without modification of the basic composition of the alloy.

SOLIDIFICATION AND GRAIN REFINEMENT PRINCIPLES

The parameters which must be controlled to refine the cast structure can be deduced from known principles of solidification. The transformation from the liquid to the solid state is a two-step process involving the nucleation of stable particles in the melt and the subsequent growth of these particles.

The nucleation phase can be a difficult step in the process (even though the solidification of all commercial alloys occurs by heterogeneous nucleation) because of the surface energy between the nucleus and the melt. This energy is primarily supplied by the bulk free energy difference between the two phases involved and requires undercooling to produce nucleation. Continued growth, once the effect of undercooling has been overcome, requires the removal of heat from the system, since the evolving heat of fusion raises the temperature at the liquid-solid interface.

A concentration gradient of solute generally forms at the liquid-solid interface during the growth of nuclei in alloy metals. This variation in composition occurs because the solute content in the solid particles rejected from the melt differs from that in the co-existing liquid. The concentration gradient in the liquid next to the advancing interface produces a corresponding gradient in the liquidus temperature distribution curve, leading to the well-known phenomenon of constitutional supercooling of the liquid adjacent to the interface. When a sufficiently shallow thermal gradient is obtained, independent nucleation in the melt ahead of the liquid-solid interface occurs. The growth of the initial solid (usually columnar) crystals will be stopped by contact with the new equiaxed crystals. This situation is favored by low pouring temperatures and fast heat extraction to increase the concentration of solute atoms in the liquid surrounding the solid grains. Interruption of the growth of columnar crystals can also be obtained by other mechanisms, but the constitutional supercooling plus separate nucleation phenomena appear to be the operative mechanisms in this invention.

Refinement of the as-cast structure requires that nucleation occur at a large number of sites and that extensive growth of crystals be avoided. It follows that grain refinement necessitates both ease of nucleation and inhibition of the continued growth of crystallites in the melt. Rapid nucleation can be achieved through numerous methods including chill action, thermal cycling, mechanical vibration, rotation, convection, and inoculation. Chilling promotes nucleation at the mold wall but does not, in itself, provide the additional nuclei required for a fine equiaxed structure unless accompanied by a very low superheat. Thermal cycling involves the partial solidification of a suitable alloy which is then remelted and poured quickly and with minimal superheat. In certain alloys, carbide and other phases are sluggish in dissolving during remelting, and can act as nucleation sites resulting in grain refinement. Mechanical vibration has been widely studied as a means of achieving grain refinement. The effect occurs because of fragmentation of dendrite arms to act as substrates or by cavitation. The disadvantages to this technique include the complexity of equipment to vibrate a heated mold in a vacuum furnace and the tendency to break molds. Rotation of the mold during solidification has also been used to control grain size and structure. In this case, the refinement is attributed to fragmentation of existing crystals which then float into the molten zone and act as nuclei. The effect of natural convection has been studied in terms of its potential in structure control. Refinement is rationalized in terms of a "raining down" of melted off dendrite fragments.

Inoculation, or the addition of stable substrates for heterogeneous nucleation, has been one of the more effective techniques for grain refinement when utilized along with constitutional supercooling. Inoculation generally refers to the addition of a substance to the melt which provides finely distributed particles on which nucleation of the parent solid can readily occur. These substance may be added to the crucible before melting, to the melt itself, or in the form of a prime-coat on the mold. The mechanism by which inoculants reduce the work of nucleation (and thus the critical nucleus size) can be rationalized in terms of interfacial energies. [Trunbull, G. K., et al, "Grain Refinement of Steel Castings and Weld Deposits", AFS Transactions, Vol. 69, 1961.] The interfacial energy between the substrate and the nucleus is substantially less than between the liquid and nucleus. This fact plus the ability of rough surfaces on substrates to lower the number of atoms required to provide a stable nucleus and to reduce the surface area in contact with the liquid account for the lower interfacial energy for nucleation attained by inoculation.

The criteria that an inoculant must possess to perform as a stable substrate for hetergeneous nucleation are not entirely established. A partial list of the prerequisites is as follows:

1. Good matching between the crystal structure of the parent solid and the inoculating particle to reduced interfacial energy at this contacting surface.

2. Stability of the particle at the freezing point of the parent material.

3. Density of the particle must be such that it is not subject to appreciable gravity segregation.

4. The substrates must be fine particles which are well dispersed.

5. Surfaces of the substrates must be clean (free or oxides or other contaminants).

6. Substrates must have rough surfaces to reduce the liquid-nucleus surface area.

In addition to the presence of stable substrates for nucleation sites, effective grain refinement depends upon the constitutional supercooling produced by solute concentrations at the advancing interface, so that the liquidus temperature in the vicinity of the substrate will decrease below the nucleation temperature. The thermal conditions that favor constitutional supercooling include a high growth rate and a shallow thermal gradient. The conditions favoring grain refinement based on inoculation and grain growth restriction from constitutional supercooling can be summarized as follows:

1. Availability of sites of easy nucleation which are well distributed throughout the melt.

2. Low pouring temperature and a preheated mold to guarantee a shallow temperature gradient in the liquid.

3. The presence of suitable solute alloys.

Grain refinement by inoculation has been successfully applied to a number of alloy systems. Most frequently used are additions which form the desired substrate after a chemical reaction in the melt, thereby providing a clean, reactive surface. Form et al [Form, G. W. et al, "Grain Refinement of Cast Metals" presented at the 27th International Foundry Congress, Zurich, 1960.] describe the addition of Co, W, and Fe powders to copper, TiC and ZrC to steel, and FeSi to gray iron. The refinement of steel by Ti addition [Wilson, P. F., et al, "Grain Refinement of Steel Castings", Journal of Metals, June, 1967.] and austenitic stainless steel by addition of Zr [Wallace, J. F., "Grain Refinement of Steels", Journal of Metals, 1963.] and CaCn [Jackson, W. J., Hall, T., "Grain Refinement in Cast Austentitic Steels", *The Solidification of Metals,* 1967.] has been documented. Cerium has been found to be an effective inoculant for certain nickel and aluminum alloys. [Tarshis, L. A., et al, "Experiments on the Solidification Structure of Alloy Castings", Metallurigical Transactions, September, 1971.] Within the abundance of information that exists in the literature, the use of elements such as Ti, Zr, C and B appear to be most favored for use as inoculants since they form compounds such as TiC, TiB, ZrC and ZrB in the melt.

Inoculation at the casting surface is also a useful technique for grain refinement. Metallic oxides such as CoO in the form of a prime coat in investment molds will be reduced to Co (when in contact with the molten metal) which acts as an inoculant. Using this technique, the surface of the casting will appear to have a fine equiaxed structure, but internally a columnar structure is present with grain size increasing toward the center of the casting.

TESTING PROCEDURE

The three alloys chosen for use as examples were 713 LC, MAR-M 246, and C 103 with their compositions as listed in Table I which follows. These alloys were selected to fulfill the following criteria:

1. Alloys tested should represent materials currently used in the production of cast turbine components.
2. The selected alloys should provide a range of composition to insure that the grain refinement technique developed will have more universal application.
3. Baseline properties of these alloys (yield strength, tensile strength, elongation, stress-rupture properties, corrosion resistance, etc.) should vary over a range typical of the family of cast superalloys.
4. Traditional, well-established alloys through "state of the art" materials should be represented.

713 LC has had widespread use for a number of years in the production of turbine components, including the test rotor. It has a rather lean composition compared to most superalloys, with no cobalt or tungsten and low carbon. This alloy is the least expensive of the three tested and is considered easy to cast in production applications. The alloy was obtained in the form of 3 inch diameter remelt stock from Special Metals Corporation, New Hartford, New York.

MAR-M 246 has also had widespread use in the production of turbine components, replacing 713 LC in some applications including a revised design of the test rotor. Compositionally, MAR-M 246 differs from 713 LC by its increased carbon (0.15% compared to 0.05% for 713 LC) and the presence of 10% cobalt and 10% tungsten which improve some properties and increase the cost per pound of the alloy. MAR-M 246 has increased strength and reduced ductility (compared to 713 LC) at temperatures up to 1800° F. This alloy was supplied in the form of 2.75 inch diameter remelt stock from the Alloy Division of Howmet Corp., Dover, N. J.

C 103 is a recently developed experimental superalloy. The most significant change in the alloy is the addition of 1% hafnium to increase transverse ductility and improve hot corrosion resistance. While aluminum plus titanium is maintained at approximately 7% for all three alloys, 4.0% titanium is used in C 103 compared to 0.75-1.5% for 713 LC and MAR-M 246. Further, columbium plus tantalum are increased in C 103 from 1.5 to 5.0% to offset the reduction in tungsten (from 10.0% to 5.0%). This alloy was supplied in the form of 2.75 inch diameter remelt stock from Detroit Diesel, Allison Division, General Motors, Indianapolis, Ind.

INVESTMENT MOLD DESIGN

Investment molds were designed to simulate the thermal history of the hub, rim, and blade sections of the test rotor. These molds were designed and produced for casting to permit the development, evaluation, and perfection of structure control techniques separately on each of the three sections before using the more expensive rotor molds. The most important parameter to be controlled is solidification time, which is proportional to $(V)^2/(SA)^2$ (V=casting volume, SA=surface area of casting), which therefore varies for the hub, rim, and blade sections. The molds must also be designed such that sound castings can be produced. The molds taper inward from the top to the bottom to insure proper feeding and are adequately risered. The volume of the casting plus the volume of the riser is limited to a maximum of eighteen, corresponding to the volume of the crucible. The geometry of the casting must be such that a maximum number of specimens can be obtained to minimize heat-to-heat variations in properties.

The hub and rim molds designed to meet these qualifications used seven layers of zircon flour slurry. Half of the molds had a CoO prime coat.

CASTING TECHNIQUE

All of the castings were produced in the vacumn induction furnace. The charge (remelt stock plus additions) is melted in a stabilized zirconia crucible which is placed within a graphite susceptor. Power is supplied by a 275 KVA, 960 cycle motor-generator set with appropriate controls. The six pound charge is melted in approximately fifteen minutes, and can then be poured by tipping the furnace toward the mold in the mold preheating oven.

For a typical heat, the technique used is as follows: After loading the charge, the furnace is evacuated to a pressure of 10–25 microns (on a production basis, a vacuum of 8–20 microns is used) requiring a pump down time of 8–12 hours using a mechanical roughing pump. The mold preheating oven is turned on, with mold temperature controlled ±15° F. The charge is then heated, and as melting begins the furnace is backfilled with ½ atmosphere of argon to prevent the loss of high vapor pressure elements and to reduce bubbling at the surface of the melt. The superheat is measured within ±5° F. using a Pt—Pt 10% Rh immersion thermocouple. When the desired superheat is achieved, the furnace is poured with a pouring time of approximately 1 second. The vacuum is then broken, and an exothermic "hot-top" compound is poured on the riser to assure soundness and avoid nucleation from particles falling from the top surface. The mold preheating oven is then turned off and the casting allowed to cool in the furnace.

Before proceeding with the development of a grain refinement technique, the values of mold preheat temperature and melt superheat temperature were established. A matrix of heats was produced with mold preheat temperature varying from 1500° F. (816° C.) to 1900° F. (1039° C.) and melt superheat varying from 200° F. (111° C.) to 350° F. (195° C.) and as high as 400° F. The combination of a 1650° F. (899° C.) mold and a 250° F. (139° C.) superheat was selected for use as baseline conditions. This selection was based on the as-cast structure which produced an average grain size (coarse columnar morphology) and secondary dendrite arm spacing that was similar to those for the test rotor produced on a commercial basis. This combination of mold temperature and superheat also results in the best as-cast mechanical properties.

With a casting process established for the production of baseline heats, a series of variations from the basic technique were evaluated in terms of their effect on control of grain size and morphology. In brief, the hub and rim molds were altered, using a CoO prime coat to produce a fine columnar structure. The alloy compositions were changed by the addition of small amounts of cerium, calcium cyanamide, nickel-boron powder, boron and zirconium to the melt. The maximum melt temperature was carefully controlled to insure the production of the proper substrates. Thermal cycling techniques with superheat temperatures as low as 50° F. (28° C.) were also employed. The end result was the production of coarse columnar, fine columnar, and fine equiaxed microstructures, with variations in casting technique from alloy to alloy. These techniques were applied to the production of hub, rim and blade sections.

RESULTS

A mold preheat temperature of 1650° F. (899° C.) in combination with a superheat of 250° F. (139° C.) was selected for use in the production of "baseline" or commercial heats of the three alloys. This selection provides a structure similar to that present in the test rotor produced on a commercial basis. The macrostructure of a baseline heat 713 LC has a coarse columnar structure having grains up to 0.5 inch diameter. A nearly identical structure is obtained from baseline heats of MAR-M 246 and C 103 with a slight increase in maximum grain size for hub molds compared to rim molds.

To obtain a fine columnar structure, an investment mold inoculated with a prime coat of cobaltous oxide (CoO) was employed. Using alloy 713 LC and thermal conditions identical to those for a baseline heat, the desired structure was produced. The molten metal came into contact with the mold wall, the CoO is reduced to Co which acts as a substrate for nucleation at the surface. The very fine columnar grains at the surface changes to extended growth of those grains oriented most favorably for growth, resulting in the grain size increasing toward the center of the casting.

EXAMPLE I — 713 LC

To obtain a fine equiaxed structure requires that nucleation occur at a large number of sites. Inoculation together with constitutional supercooling has been found to be the most effective technique for grain refinement, with Ti, Zr, B and C most widely used as inoculants and the solute elements present in the alloy. For the alloys under consideration, titanium and carbon contents are closely controlled to allow the formation of a suitable proportion of gamma prime and carbides for optimum mechanical properties, but sufficient latitude is available for additions of these elements as inoculants without major microstructural changes. Using an inoculated mold preheated to 1600° F, additions of 0.1 wt. % Zr (in sponge form) and 0.1 wt. % B (elemental powder wrapped in nickel foil packets) were made to a crucible charged with 713 LC.

To obtain refinement, suitable substrates must be formed in the melt. From the Ti-B-C ternary phase, it is apparent that the melt must be heated in excess of 2730° F. (1510° C.) to form TiB and TiC, with melt temperatures in excess of 2804° F. (1540° C.) required to form $TiB_2$. Based on this information, the maximum melt temperature was established as 2850°-2900° F. (1565°-1594° C.) After the maximum temperature is achieved, the charge is allowed to cool in the crucible until solidification has progressed sufficiently. The charge is then reheated and poured quickly with a 50°-100° F. (28°-55° C.) superheat.

This is a fine equiaxed structure with a grain size of ASTM No. 3. The same technique was then applied to the larger hub mold. This fine equiaxed structure (with a thin columnar region at the surface) has a grain size of ASTM No. 2.

EXAMPLE II — MAR-M 246

This technique was next applied to alloy MAR-M 246 hub and rim molds, using the same additions. The equiaxed grain sizes are ASTM No. 4 and ASTM No. 3.5 for the rim and hub sections, respectively. The additional refinement in this alloy compared to that of 713 LC is attributed to the higher carbon and refractory content of MAR-M 246.

EXAMPLE III — C 103

The application of the previously described technique proved unsuccessful with rim sections of alloy C 103. A coarse columnar structure was produced. In alloy C 103 the most significant alloying addition (compared to 713 LC and MAR-M 246) is 1% hafnium. Since the existing grain refinement theory is based on the formation of titanium and zirconium borides and carbides in the melt (which then act as substrates for heterogeneous nucleation), it is significant that a higher negative free energy of formation exists for hafnium borides and carbides than for the titanium and zirconium counterparts. The hafnium in the alloy would be expected to react preferentially with the boron and carbon, reducing the amount available to the titanium and zirconium. The hafnium borides and carbides apparently do not act as effective substrates for reasons that will be discussed later.

To verify the presence of hafnium as the source of the problem, a heat was made using alloy MAR-M 246 and a 1% addition of hafnium. The casting technique employed was that which previously produced refinement in MAR-M 246. The resulting macrostructure was a coarse equiaxed structure, with a region of fine columnar grains at the surface.

To overcome the influence of the hafnium, an addition of 1% calcium cyanamide ($CaCn_2$) was made to provide nitrogen to tie up the hafnium and thereby free some carbon to react and form substrates. This technique, coupled with the elimination of the use of hot top (to allow melted off dendrites to "rain down" and act as nuclei) produced the refinement, i.e. a wholly equiaxed structure with an average grain diameter of 0.15 inch. While this technique produced promising results in terms of structure control, the $CaCn_2$ addition formed a "slag" which bridged across the crucible, greatly hindering temperature measurement and pouring. Based on the work of Tarshis et al, [Tarshis, L. A., et al, "Experiments on the Solidification Structure of Alloy Castings", Metallurgical Transactions, September, 1971.] the effect of an addition of 1% cerium to C 103 was evaluated. An equiaxed structure with grain size slightly larger than that produced by $CaCn_2$ additions was the result.

Since these other inoculants proved ineffective in producing a fine equiaxed structure in C 103, boron and zirconium additions were employed using a modified process. Two approaches to this problem were available:

1. Alter the hafnium borides and carbides to convert them to suitable substrates such as by the addition of an alloying element to precipitate on the hafnium compounds and alter their surface character.

2. Suppress the formation of the hafnium compounds while promoting the formation of titanium and zirconium borides and carbides.

The first alternative proved to be unsuccessful, but the second procedure provided refinement. A comparison of the Ti—ZR—B and the Ti—Hf—B ternary phase diagrams indicates that the titanium and zirconium borides begin to form upon cooling from temperatures above 2630° F. (1432° C.) while the hafnium borides can begin to form upon cooling from temperatures over 2760° F. (1516° C.). Therefore, heating to the intermediate temperature range between 2630° F. and 2760° F. could result in the formation of effective substrates with a minimal loss of substrates from the presence of hafnium.

EXAMPLE IV — C 103

Using boron and zirconium as inoculants and a cobaltous oxide coated rim mold, a C 103 heat was made by heating to approximately 2660° F. (1460° C.) and then pouring with a 50° F. (28° I C.) superheat. The periphery is composed of fine columnar grains because of the action of the mold inoculant; the body of the casting is equiaxed with an average grain diameter of 0.07 inch. While this structure is not as fine grained as those of 713 LC or MAR-M 246, it represents a significant improvement over previous attempts with C 103.

A second heat was made under the same conditions with the maximum temperature increased to the upper limit (2760° F.) specified by the phase diagrams. This macrostructure is wholly equiaxed, with an average grain diameter of 0.004 (ASTM No. 3.5). The same technique was then applied to an inoculated hub mold. Again, the structure is wholly equiaxed with an average grain diameter of 0.005 inch (ASTM No. 3).

For all three alloys, the minimum grain diameter for refined castings is very nearly equal to the secondary dendrite arm spacing of baseline castings. Further refinement of equiaxed grains can be obtained by varying the local solidification time, a technique which is used to refine secondary arm spacing of columnar castings. This results in a range of equiaxed grain sizes produced by variations in pouring temperature and mold preheat temperature.

EXAMPLE V — C 103

Further examples were completed using 0.01% to 0.2% by weight boron with comparable results in physical properties and grain size. Zirconium 0.01 to 0.2% by weight produced equivalent results.

EXAMPLE VI

In still another example 16 heats were run. All heats were run using MAR-M 246 because of the significant improvement in mechanical properties which this alloy exhibited upon grain refinement. Some of the heats were melted with one-half atmosphere of argon (inert gas) in the melt chamber, and others were melted in vacuum. Additions of 0.1% boron and/or zirconium were charged with remelt stock. Various combinations of thermal cycles and superheats (pour temperature) were tried in an effort to establish the most reliable and feasible method of grain refinement for use in a production facility. Because the experiments were conducted to find the limits of the process, only two heats were completely grain refined. In heat No. 3 argon was used with 0.1% boron, no zirconium, 50° F. superheat for pouring, and the regular thermal cycle (2800° F., freeze) to produce an equiaxed 0.004 inch grain size (ASTM No. 3.5).

In heat No. 10 argon was not used, but 0.1% boron, 100° F. superheat pour produced an equiaxed 0.006 grain size. This was a production run. It was noted that heat No. 10 was grain refined without the one-half atmosphere of argon in the melt chamber. Attempts to grain refine in the laboratory without back filling with argon were unsuccessful; however, this was attributed to the relatively poor (30 micron) vacuum which the experimental furnace provided. This inferior vacuum increased the difficulty of introducing boron into the melt with the movement of gases over the melt. The very good vacuum (less than 1 micron) which was achieved on the production melting unit eliminated this problem. For this reason grain refinement can be realized in the production environment utilizing conventional vacuum melting procedures.

In other heats regardless of the vacuum, or use of argon, it was not possible to obtain the grain refinement sought. In some heats boron and/or zirconium were omitted and large grains resulted. In another 100° F. to 200° F. superheat pour, columnar structure and large grains resulted. The object learned is that low pouring temperature promoted grain refinement Following the above, a set of heats was run as in the manner of No. 3 and No. 10 with zirconium and no boron which produced an equiaxed structure 0.0061 inch grain size. The other experimental conditions were as described, previously.

EXAMPLE VII

In a further test with MAR-M 246 a series of heats were cast using the technique employed previously. One heat was a control sample cast with normal production procedures. The remaining heats were cast with 0.1% boron by weight melted under vacuum (1 micron). These alloys were melted at +300° F. superheat for the control, and each sample was run at a different superheat temperature, namely, +400°, +400°, +400°, +450° F., and +375° F., respectively. They were poured at +300° F. for the control and +10° F., +25° F., 15° F., +15° F., and +25° F. for the five samples. All samples produced equiaxed grains 0.004 inch in size, whereas the control was columnar and 0.250 inch in grain size. Because of mold filling problems, it was concluded that it is advantageous to use slightly higher pouring temperatures such as +50° F. superheat. Mechanical testing confirmed the earlier results.

MICROSTRUCTURAL ANALYSIS

Considerable variation exists on the microstructure from alloy to alloy as well as for a particular alloy in the refined and non-refined condition. A microstructural analysis was performed on the previously discussed castings to describe and compare the carbide morphology, grain boundary structure and gamma prime size and distribution. The grain boundaries are smooth and rounded, connected by the characteristic "Chinese script" carbide morphology. The gamma prime phase is more prominent, occupying a volume fraction of between 60–70%. Two types of carbides are present, the large, blocky MC carbides and the angular, elongated $M_{23}C_6$ occupying a portion of the grain boundaries. This structure is unchanged with the addition of the cobaltous oxide mold prime coat.

Using the grain refinement technique discussed previously (B plus Zr additions) results in a modification of the carbide morphology from a script type to a cellular type. While this cellular carbide morphology is generally regarded as being detrimental to ductility, the extent of damage to properties is strongly dependent on the amount of grain boundary gamma prime which surrounds the carbides. A "skeletal" phase identified as a boride is also present in the refined microstructure.

MAR-M 246 in the refined condition shows both cellular and script carbide morphology with a higher volume fraction of MC carbides compared to 713 LC because of the higher carbon and refractory content in this alloy. Grain boundaries are smooth and angular, and the gamma prime volume fraction is comparable to that of 713 LC.

In micrographs of a baseline heat of alloy C 103, there is a marked change in the gamma prime phase with the appearance of circular islands of gamma/gamma prime eutectic. While some script type carbides remain in the grain boundaries, the grains are populated with large angular (hexagonal) carbides. Micrographs of this alloy in the "refined" condition ($CaCn_2$ addition) show the convoluted grain boundary geometry resulting from the presence of the gamma/gamma prime eutectic islands. The grain boundary carbides have assumed a cellular morphology as experienced with the other alloys following refinement. These have a typical island surrounded by celluar carbides and skeletal borides. The pronounced microstructural changes (convoluted grain boundary geometry; large, angular MC carbides; gamma/gamma prime eutectic) are the result of the 1% hafnium present in the alloy. This was confirmed by the addition of 1% hafnium to MAR-M 246.

The microstructure of C 103 has undergone considerable change during grain refinement. Most significant is the increase in the volume fraction in the gamma/-gamma prime eutectic with a decrease in the number and size of the angular carbides within the grains. The microstructure of a rim section of C 103 inoculated with $CaCn_2$ produced an average grain diameter of 0.15inch. A rim section heated to 2660° F. (1460° C.) resulted in an average grain diameter of 0.005 inch. A rim heated to 2760° F. resulted in an average grain diameter of 0.004 inch. With an increase in gamma/gamma prime eutectic there was a decrease in grain size. Since the gamma/-gamma prime eutectic forms upon the addition of hafnium, and based upon the theory that the formation of hafnium carbides and borides retards grain refinement, it follows that by preventing the formation of the hafnium compounds, a greater amount of hafnium is available for the formation of the gamma/gamma prime eutectic phase.

MICROPROBE ANALYSIS

An electron microprobe analysis was performed on grain refined rim sections of the three alloys to investigate the partitioning of the major alloying elements.

In alloy 713 LC, the carbides are denuded of nickel with titanium-rich MC carbides and chromium and molybdenum-rich $M_{23}C_6$ carbides as predicted by the equation:

$$MC + \text{gamma} \rightarrow M_{23}C_6 + \text{gamma prime or}$$

$$(Ti,Mo)\,C + (Ni, Cr, Al, Ti) \rightarrow Cr_{21}Mo_2C_6 + Ni3\,(Al, Ti)$$

Little information was gained on the partitioning of Ta and Zr or B. Aluminum is uniformly distributed in the gamma prime.

A similar result is present for alloy MAR-M 246, with carbides lean in terms of Ni and Co and Ta, Zr, and Ti partitioned to the MC carbides. The $M_{23}C_6$ carbides are rich in Cr, Mo, and W. Little information is available on C and B which are present in small concentrations and as light elements are difficult to detect. The Al is uniformly distributed in the gamma prime.

In alloy C 103, the hafnium is partitioned in two important locations. Higher concentrations of Hf are present in the gamma/gamma prime eutectic phase compared to the matrix. This element is also concentrated in the angular primary carbides characteristic of hafnium-modified alloys. Two types of primary carbides form; one of these is hafnium rich, the other Ti rich in the form:

$$Mc = (Ti, Hf)C$$

Within the primary carbides the Hf tends to accumulate at the periphery with Ti at the center. This tendency was confirmed by measuring hafnium and titanium counts per second while traversing a carbide at high magnification. At the carbide periphery, hafnium counts are increased by a factor of 3 or 4 compared to the center of the carbide. The reverse is true for titanium with counts per second decreasing by a factor of 2 or 3 from the center to the edge of the carbide.

The discrete nature of the hafnium-rich carbides (as opposed to a script morphology) suggests that these carbides form early in the solidification process, consuming much of the available carbon. This change in the solidifcation sequence would occur if hafnium depressed liquidus and solidus temperatures of the alloys; this circumstance has been observed.

These results provide a clue regarding the difficulty of grain refining the hafnium-modified alloys. Based on the assumption that the formation of carbides and borides in the melt results in stable substrates for nucleation, a smooth angular carbide could fail to act as an effective substrate since the "surface roughness" criterion would not be met. Further, a poor match occurs between the crystal structure of the parent solid and the inoculating particle. The lattice parameter of HfC (4.64A) is considerably larger (32%) than that of the nickel matrix (3.52 A).

All three alloys are generally insensitive to increasing test temperature in terms of yield strength and tensile strength. For baseline heats, the yield strength increases from about 110ksi for 713 LC to 125ksi for MAR-M 246 and 130ksi for C 103. Grain refinement results in an increase in yield strength for 713 LC (120ksi) and MAR-M 246 (135ksi) with a slight decrease in tensile strength for these alloys. Both the yield (128ksi) and tensile strengths of C 103 decrease following grain refinement. Columnar grained castings show reduced tensile and yield strengths in comparison to their baseline and refine counterparts. This tensile data falls within the band established for cast nickel-base superalloys, as shown in a plot of yield strength versus temperature and tensile strength versus temperature.

At temperatures above 1200° F., all three alloys undergo a decrease in ductility. This characteristic feature of nickel-base superalloys is significant. Alloy 713 LC has considerably greater ductility (12% elongation) than MAR-M 246 (5%) and C 103 (6%) in both the baseline and refined states because of the relatively small volume fraction of carbides in this low carbon alloy. Grain refinement produces a decrease in ductility for a given alloy and test temperature. This can be attributed to the increase in brittle constituents (such as skeletal networks of borides and altered carbide morphologies) which form during refinement. The columnar grained castings have ductility values greater than refined castings but less than baseline castings. This is the result of the alignment of the columnar grain boundaries normal to the major stress axis, reducing ductility compared to baseline castings without the presence of the boride and altered carbide networks.

OBSERVATIONS OF FATIGUE TESTS

1. The baseline material shows considerably greater scatter than the refined material because of the anisotropy effects. An accurate assessment of the limits of the scatter band requires testing a much greater number of specimens. The limits of the scatter band are essential to designers who intend to use the lower limit in the design of a rotor.

2. For alloys 713 LC and MAR-M 246, the slopes of the fatigue curves follow the relation:

$$(2N_f)^x \Delta_{eT} = K$$

with K varying from 0.032 for 713 LC columnar to 0.07 for MAR-M 246 refined and X = 0.24. Alloy C 103 has a considerably shallower slope and does not conform to this behavior.

3. The performance of baseline MAR-M 246 and baseline 713 LC is nearly identical. Columnar grained MAR-M 246 has a distinct advantage over columnar 713 LC. 4. The fatigue performance of refined 713 LC and MAR-M 246 is superior to their respective columnar or baseline grain structures. At a strain amplitude of 0.003, refined MAR-M 246 has a factor of four increase in cycles to failure compared to baseline MAR-M 246. Refined 713 LC has fatigue life increased 2 times that of baseline 713 LC at the same strain amplitude.

5. The shallow slope of the 3 strain-life curves for C 103 indicates that this alloy is extremely sensitive to small changes in strain amplitude. This alloy is also insensitive to changes in grain morphology, with columnar, baseline and refined data falling on nearly the same line.

The poor strength behavior of the columnar grained alloy in room temperature fatigue and room and elevated temperature tensile tests predicates the elimination of this grain morphology in future testing. Emphasis is, therefore, focused on the performance of baseline and refined material.

At 1000° F., the elongation of 713 LC baseline has decreased from 15% to 12%, with MAR-M 246 baseline dropping from 8.7% to 5.0%. Refined 713 LC, refined MAR-M 246 and C 103 baseline and refined show a much smaller decrease in ductility over the same temperature range. The mechanism by which this decrease in ductility affects the slope of the fatigue curve can be explained in terms of the elastic and plastic strain contributions to the total strain life-curve. At low strain amplitudes the fatigue performance is dependent mainly upon the strength of the material since the straining is almost totally elastic. At higher strain amplitudes, the dominance of the elastic factor is reduced as the amount of plastic straining increases. The importance of material ductility, as reflected by the fatigue ductility exponent and coefficient, increases with increasing plastic strain. Therefore, the reduced ductility present at 1000° F. results in decreased high strain fatigue life with low strain fatigue lift unaffected, thereby reducing the slope of the fatigue curve.

The fatigue curves for rim material tested at 1400° F. (760° C.) have the following significant features:

1. The performance of refined MAR-M 246 and refined 713 LC is superior to that of baseline heats of those materials.

2. The slopes of all six fatigue curves are reduced compared to the 1000° F. data. This is again the result of a ductility loss, with the minimum in the ductility versus temperature occurring at 1400° F. The reduced slopes have the parameters X = 0.20 for 713 LC and X = 0.18 for MAR-M 246.

3. At high strain amplitudes, 713 LC has considerably better fatigue life than MAR-M 246 or C-103. This is attributed to the ductility of 713 LC which, at 1400° F., is three times of MAR-M 246 or C 103. At lower temperatures 713 LC had nearly double the ductility of MAR-M 246, but the strength advantage of MAR-M 246 was sufficient to compensate for its inferior ductility.

4. At low strain levels MAR-M 246 has the superior fatigue life. Since the straining is elastic in this region, the strength of MAR-M 246 dominates.

5. At low strain levels, the fatigue life of MAR-M 246 and C 103 is superior (at 1400° F.) to that at room temperature. At 1400° F., the decrease in the modulus of elasticity results in less stress required to achieve a given strain. Since the fatigue test is being conducted in a strain control mode, specimens at the same strain level are subject to less stress at 1400° F. than at room temperature. While the modulus decreases with temperature, the yield strengths of these alloys are essentially constant up to 1400° F. Therefore, under wholly elastic strain conditions, fatigue life at 1400° F. will be superior to that at room temperature.

For MAR-M 246 and 713 LC, refined specimens have superior fatigue performance compared to their baseline counterparts. The fatigue parameters for room temperature hub mold specimens are X = 0.24 and K = 0.072 for MAR-M 246 refined and K = 0.051 for 713 LC baseline. Again, C 103 has a much shallower slope of the $\Delta\epsilon_T/2$ vs, $2N_f$curve than 713 LC or MAR-M246.

The 500° F. fatigue performance of hub mold material shows at this low test temperature the fatigue curves are nearly identical to those at room temperature. This is the expected result since there are no significant changes in tensile properties at 500° F. compared to room temperature.

The fatigue curves for each of the alloys at various test temperatures and grain morphologies show for 713 LC the decrease in slope of the fatigue curves with increasing test temperature, which is apparent for both baseline and refined materials. Baseline material is more susceptile to the slope change as it experiences a greater decrease in ductility with increasing temperature.

The behavior of MAR-M 246 is significantly different as the slopes of the fatigue curves decrease with increasing temperature. However, the baseline and refined curves, at a given temperature, remain nearly parallel. The high temperature, low strain behavior of MAR-M 246 is interesting since the reversals to failure exceed those for room temperature specimens at the same strain amplitude.

C103 has the unique characteristic of being insensitive to changes in test temperature or grain morphology with extreme sensitivity to changes in strain amplitude. At low strain amplitudes this material is comparable to the other alloys in terms of fatigue life, but at strain amplitudes in excess of 0.004 inch/ it is decidedly inferior.

With respect to the foregoing specification, it is important to state that MAR-M 246 is a trademark for a Martin Marietta Corporation alloy; INCO 713 LC or 713 LC is a trademark for an International Nickel Company alloy; and C 103 is a trademark for an Allison Division of General Motors Company alloy.

SUMMARY AND CONCLUSIONS

The subject invention concerns the influence of grain refinement and microstructural control on the significant properties of nickel-base superalloys for use in integrally cast turbine rotors and other super-alloy applications. The alloys testes were 713 LC, MAR-M 246 and C 103, and the properties investigated were tensile (room temperature to 1400° F.), mechanical fatigue (room temperature to 1400° F.), thermal fatigue, hot corrosion, and stress rupture.

1. The present invention consists of a gain refinement technique in which:
   a. An alloying addition of 0.1% B and optionally 0.1% Zr is made.
   b. Melting in a vacuum furnace or back filling the chamber with one-half atmosphere of argon to prevent the loss of said alloying additions.
   c. For 713 LC and MAR-M 246 the melt must be raised to temperatures in excess of 2800° F., i.e. 350° F. superheat, before cooling to insure the formation of proper nucleation substrates. For C 103, the maximum temperature must be between 2630° F. and 2760° F, i.e. 300° F. superheat.
   d. Cooling until partial solidification has occurred.
   e. Reheating and pouring with approximately 50°–100° F. superheat.
   f. Refinement is attributed to the formation of titanium and/or zirconium borides which act as stable substrates for nucleation.
2. Tensile Test Results:
   a. Coarse grained samples showed considerable anisotropy.
   b. Grain refinement produced an increase of 10ksi in the yield strength of 713 LC and MAR-M 246 with a slight decrease in tensile strength. Both the yield and tensile strengths of C 103 decrease following grain refinement. Grain refinement also produces a decrease in ductility for a given alloy and test temperature.
3. Low-cycle mechanical fatigue results:
   a. Grain refinement produces an increase in fatigue life by a factor of 2–4, i.e. the base alloy lasted 700 hours and this new alloy 1500 to 3000 hours.
   b. As the test temperature increases, the slopes of the strain life curves decrease due to the ductility loss at elevated temperatures. At low strain amplitudes, fatigue life increases with increasing temperature.
   c. The fatigue performance of C 103 is insensitive to changes in test temperature and grain morphology, but it is extremely sensitive to strain amplitude.
4. Thermal fatigue test results:
   a. Burner rig testing failed to produce thermal fatigue cracks in baseline or refined specimens of the three test alloys.
   b. The corrosion rate (as measured by weight change) was increased for grain refined samples.
   c. The corrosion rate of C 103 (baseline and refined) was significantly greater than that for the other alloys.
   d. The increased corrosion rate of C 103 was attributed to the insufficient aluminum content in this alloy.
5. Fatigue failure mechanisms:
   a. Inclusions, microshrinkage and precracked carbides at the specimen surface act as stress raisers to promote microcrack formation.
   b. Microcracks propagate slowly as they link up with each other and with discontinuities such as cracked carbides or microshrinkage.
   c. Catastrophic crack propagation results when the critical crack length is attained (for a given geometry, material and test conditions).
6. Commercial significance of results:
   a. Based on the results of a series of preliminary tests, it was verified that the structure control techniques developed can be applied in a production environment.
   b. Either 713 LC or MAR-M 246 in the grain refined condition are preferred for use in integrally cast turbine rotors. These alloys offer a definite improvement in low-cycle fatigue properties without a sacrifice in castability or cost, and are most easily adapted to current production equipment.
   c. C 103 is less suitable for use in the rotor application tested.

TABLE I

| Element | COMPOSITION OF ALLOYS 713 LC | MAR-M 246 | C 103 |
|---|---|---|---|
| Carbon | 0.03 - 0.07 | 0.15 | 0.14 - 0.18 |
| Chromium | 11.00 - 13.00 | 9.00 | 11.2 - 11.8 |
| Molybdenum | 3.80 - 5.20 | 2.50 | 1.75 - 2.25 |
| Columbium Tantalum | 1.50 - 2.50 | 1.50 | 4.80 - 5.20 |
| Aluminum | 5.50 - 6.50 | 5.5 | 3.30 - 3.70 |
| Titanium | 0.40 - 1.00 | 1.5 | 3.80 - 4.20 |
| Boron | 0.005 - 0.015 | 0.015 | 0.010 - 0.020 |
| Zirconium | 0.05 - 0.15 | 0.05 | 0.05 - 0.12 |
| Silicon | 0.05 max. | 0.05 | 0.30 max. |
| Manganese | 0.50 max. | 0.10 | 0.20 max. |
| Iron | 0.50 max. | 0.15 | 0.50 max. |
| Copper | 0.50 max. | LAP* | LAP* |
| Sulfur | 0.015 max. | LAP* | 0.015 max. |
| Cobalt | — | 10.0 | 8.0 - 9.0 |
| Tungsten | — | 10.0 | 4.8 - 5.2 |
| Hafnium | — | — | 0.80 - 1.202 |
| Nickel | Balance | Balance | Balance |

*Low as Possible

The invention has been described with reference to the preferred embodiment. Obviously, modifications and alterations will occur to others upon the reading and understanding of the specification. It is our intention to include all such modifications and alterations insofar as they come within the scope of the appended claims or equivalents thereof.

What is claimed is:

1. A method for producing heterogeneous nuclei in test nickel-base superalloys which results in the grain refinement of said superalloys and in the improvement of the low cycle fatigue properties in said superalloys while mantaining the present stress rupture properties of said superalloys, comprising:
   charging a nickel-base superalloy in a crucible;
   adding to said superalloy from 0.01 to 0.20 percent of a member selected from the group consisting of boron, zirconium and mixtures thereof for causing the formation of a substrate for heterogeneous nucleation;
   melting said charged nickel-base superalloy and said selected member in a vacuum furnace;
   superheating said charged nickel-base superalloy and said selected member to a temperature of about 250° F. to about 400° F. above said melting temperature in a period of about two minutes to about eight minutes to form heterogeneous nuclei in said nickel-base superalloy; and
   cooling until partial solidification, reheating and pouring said superalloy with about 50° F. to about 100° F. of superheat, whereby an equiaxed fine grain structure results in said superalloy.

2. The method as described in claim 1 wherein said nickel-base superalloy is:

carbon; 0.02 - 0.35
chromium; 6.0 - 17.0
molybdenum; 2.5
columbium, Tantalum; 0.25 - 3.0
aluminum; 2.0 - 8.0
titanium; 0.1 - 3.0
boron; 0.001 - .2
zirconium; 0.001 - .5
cobalt; 2.0 - 15.0
tungsten; 5.0 - 20.0
nickel; Balance plus impurities as low as possible.

3. The method as described in claim 1 wherein said nickel-base superalloy is:

carbon; 0.03 - 0.07
chronium; 11.0 - 13.0
molybdenum; 3.8 - 5.20
columbium, tantalum; 1.50 - 2.50
aluminum; 5.50 - 6.50
titanium; 0.40 - 1.00
boron; 0.005 - 0.015
zirconium; 0.05 - 0.15
nickel; Balance plus impurities as low as possible.

4. The method as described in claim 1 wherein said nickel-base superalloy is:

carbon; 0.14 - 0.18
chromium; 11.2 - 11.8
molybdenum; 1.75 - 2.25
columbium, tantalum; 4.80 - 5.20
aluminum; 3.30 - 3.70
titanium; 3.80 - 4.20
boron; 0.010 - 0.020
zirconium; 0.05 - 0.12
cobalt; 8.0 - 9.0
tungsten; 4.8 - 5.2
hafnium; 0.80 - 1.202
nickel; Balance plus impurities as low as possible.

5. The method as described in claim 1 wherein said casting takes place in an inert atmosphere.

6. The method as described in claim 1 wherein said added selected member is 0.1 percent boron.

7. The method as described in claim 1 wherein said added selected member is a combination of 0.1 percent boron and 0.1 percent zirconium.

8. A method of grain refining cast nickel-base superalloys which comprises:

combining said superalloy with 0.01 percent to 0.20 percent of a member selected from the group consisting of boron, zirconium and mixtures thereof;

melting said superalloy and said selected member in a furnace;

superheating said superalloy and said selected member to a temperature of about 250° to about 400° F. above said melting temperature in a period of about 2 minutes to about 8 minutes; and cooling until partial solidification, reheating and pouring said superalloy with about 50° F. to about 100° F. superheat, whereby an equiaxed fine grain structure results in said superalloy.

9. The method of claim 8 in which said furnace is a vacuum furnace.

10. The method of claim 8 in which an inert atmosphere is used in said furnace.

11. The method of claim 8 in which said selected member is 0.1 percent boron.

12. The method of claim 8 in which said selected member is a combination of 0.1 percent boron and 0.1 percent zirconium.

13. A new, improved cast nickel-base superalloy consisting essentially of the following approximate composition:

Carbon; 0.02 - 0.17
Chromium; 6.0 - 20.0
Cobalt; 2.0 - 15.0
Molybdenum; 1.7 - 6.0
Tungsten (W); 2.5 - 20.0
Columbium, Tantalum; 0.9 - 6.5
Iron; 0 - 4.5
Titanium; 0.1 - 4.7
Aluminum; 2.0 - 8.0
Boron; 0.001 - 0.20
Zirconium; 0.001 - 0.50
Nickel; Balance plus impurities as low as possible, the improvement of which consists of a grain refining agent having 0.01 percent to 0.20 percent selected from the group consisting of boron, zirconium and mixtures thereof, and further being characterized by a fine equiaxed grain structure with an ASTM grain size of two or finer and by improved fatigue life at both room and elevated temperatures (1400° F.) by a factor of at least four in terms of strain reversals to failure in the range of 0.001 to 0.008 strain amplitude without deterioration of stress rupture life to temperatures as high as 1800° F. when compared to the same cast nickel-base superalloy in the non-grain refined condition.

14. The improved composition of claim 13 wherein said grain refining agent is 0.1 percent boron.

15. The improved composition of claim 13 wherein said grain refining agent is a combination of 0.1 percent boron and 0.1 percent zirconium.

16. A new, improved cast nickel-base superalloy having a fine equiaxed grain structure and improved fatigue life at both room and elevated temperatures (1400° F.), formed by a process involving:

charging a nickel-base superalloy in a crucible;

adding to said superalloy from 0.01 to 0.20 percent of a member selected from the group consisting of boron, zirconium and mixtures thereof for causing the formation of a substrate for heterogeneous nucleation;

melting said charged nickel-base superalloy and said selected member in a vacuum furnace;

superheating said charged nickel-base superalloy and said selected member to a temperature of about 250° F. to about 400° F. above said melting temperature in a period of about 2 minutes to about 8 minutes to form heterogeneous nuclei in said nickel-base superalloy; and cooling until partial solidification, reheating and pouring said superalloy with about 50° to about 100° F. of superheat, whereby an equiaxed fine grain structure results in said superalloy.

* * * * *